US005171906A

United States Patent [19]

Kawakami et al.

[11] Patent Number: 5,171,906

[45] Date of Patent: * Dec. 15, 1992

[54] PROCESS FOR TREATING BY-PRODUCT OIL

[75] Inventors: Shigenobu Kawakami, Ichikawa; Keiji Endo, Yokosuka; Hideyuki Dohi, Yokohama; Atsushi Sato, Tokyo, all of Japan

[73] Assignee: Nippon Petrochemicals Company, Limited, Tokyo, Japan

[ * ] Notice: The portion of the term of this patent subsequent to Jan. 1, 2008 has been disclaimed.

[21] Appl. No.: 476,417

[22] PCT Filed: Aug. 11, 1989

[86] PCT No.: PCT/JP89/00822

§ 371 Date: Apr. 24, 1990

§ 102(e) Date: Apr. 24, 1990

[87] PCT Pub. No.: WO90/01528

PCT Pub. Date: Feb. 22, 1990

[30] Foreign Application Priority Data

Aug. 13, 1988 [JP] Japan ..... 63-202405

[51] Int. Cl.[5] ..... H01B 3/22; C07C 15/12

[52] U.S. Cl. ..... 585/25; 585/6.3

[58] Field of Search ..... 585/6.3, 25

[56] References Cited

U.S. PATENT DOCUMENTS

| | | | |
|---|---|---|---|
| 1,878,509 | 9/1932 | Michel | 585/6.3 |
| 4,111,824 | 9/1978 | Schulz et al. | 585/25 |
| 4,111,825 | 9/1978 | Schulz et al. | 585/6.3 |
| 4,219,687 | 8/1980 | Dolhyj et al. | 585/25 |
| 4,326,994 | 4/1982 | Haag et al. | 252/455 |
| 4,418,235 | 11/1983 | Haag et al. | 585/407 |
| 4,601,993 | 7/1986 | Chu et al. | 502/66 |
| 4,642,730 | 2/1987 | Sato et al. | 585/25 |
| 4,870,221 | 9/1989 | Sato et al. | 585/6.3 |
| 4,899,009 | 2/1990 | Kawakami et al. | 585/471 |
| 4,902,841 | 2/1990 | Kawakami | 585/25 |
| 4,982,025 | 1/1991 | Kawakami | 585/25 |

FOREIGN PATENT DOCUMENTS

| | | | |
|---|---|---|---|
| 47-5750 | 2/1972 | Japan . | |
| 54900 | 5/1974 | Japan | 585/6.3 |
| 51800 | 5/1976 | Japan | 585/6.3 |

*Primary Examiner*—Helane Myers

*Attorney, Agent, or Firm*—Fisher, Christen & Sabol

[57] ABSTRACT

A process for treating a by-product oil is disclosed, which comprises treating a raw material containing a heavy oil formed as a by-product in the step of producing alkylbenzene or the like by alkylation of benzene or the like, with a catalyst of crystalline synthetic zeolite having a $SiO_2/Al_2O_3$ (molar ratio) of 20 or more and inlets of main pores (main cavity openings) of ten-membered oxygen rings in a liquid phase at a temperature of 320° C. or below, wherein said raw material contains up to 2 wt % of methylnaphthalene. This process makes it possible to prevent reduction in the catalytic treatment efficiency.

20 Claims, No Drawings

PROCESS FOR TREATING BY-PRODUCT OIL

DESCRIPTION

1. Technical Field

This invention relates to a process for treating heavy by-product oil in a state to decrease the lowering in the treatment efficiency, which by-product oil is produced in the process to prepare ethylbenzene and ethyltoluene.

2. Background Art

The heavy by-product oil obtained in the preparation of ethylbenzene and ethyltoluene contains diphenylethanes and the like and several uses of the by-product oil have been hitherto proposed.

Most of conventional proposals, however, relates to the uses of the by-product oils themselves as electrical insulating oils or solvents. Any proposal to use treated by-product oil is scarcely known.

One of the reason for the above fact is that, for example, when the above-mentioned heavy by-product oil is treated with a catalyst of crystalline synthetic zeolite, the treatment cannot be worked practically because the lowering of treatment efficiency of catalyst is severe.

Furthermore, the by-product oil is sometimes subjected to refining treatment with active clay when it is used as a solvent, in which the treatment can be generally carried out without any trouble.

In order to solve the above problems, the inventors of the present application have carried out extensive investigation. As a result, present invention has been accomplished.

DISCLOSURE OF INVENTION

The present invention relates to a process for treating a raw material containing heavy by-product oil as a material to be treated without lowering the treatment efficiency, which by-product oil is obtained in the process to prepare alkylbenzene or alkyltoluene by alkylating benzene or toluene with an alkylating agent in the presence of an alkylation catalyst. The treating method is characterized in that the material to be treated containing 2% by weight or less of methylnaphthalene is treated at a treating temperature of 320° C. or below in the presence of a catalyst of crystalline synthetic zeolite which is 20 or higher in the value of $SiO_2/Al_2O_3$ (molar ratio) and the inlets of main pores (cavity openings) of which are composed of ten-membered oxygen rings.

In the following, the present invention is described in more detail.

The material to be treated in the present invention is heavy by-product oil which is obtained as a by-product in the process to prepare alkylbenzene or alkyltoluene by alkylating benzene or toluene with an alkylating agent in the presence of an alkylation catalyst.

The preparation process for alkylbenzene or alkyltoluene is exemplified by a process to alkylate benzene or toluene in the presence of an acid catalyst such as aluminum chloride, phosphoric acid or synthetic zeolite to obtain ethylbenzene or ethyltoluene. These ethylbenzene and ethyltoluene are dehydrogenated to obtain styrene or methylstyrene which are used as polymer materials and for other various purposes in a large quantity in industries.

In the above alkylation process, a crude alkylation product containing unreacted benzene, unreacted toluene, ethylbenzene, ethyltoluene, polyethylbenzene, polyethyltoluene and heavy components, is produced.

From this crude alkylation product, low boiling components such as unreacted benzene, unreacted toluene, ethylbenzene, ethyltoluene, polyethylbenzene and polyethyltoluene are distilled off.

The heavy by-product oil used in the present invention is obtained by distilling again the residue in the above distillation or by distilling simultaneously with the above distillation to remove the low boiling components. Preferable heavy by-product oil is the one which contains main components in the boiling range of 240° C. to 350° C. (hereinafter as atmospheric pressure unless otherwise indicated) and more preferably in the range of 245° C. to 350° C.

The heavy by-product oil obtained in the above alkylation process generally contains inevitably more or less methylnaphthalene and it also contains other various compounds because it is a by-product oil. Even though the quantity of methylnaphthalene can be varied by selecting the conditions for alkylation and distillation, it is generally contained up to 10% by weight at the maximum.

In order to reduce the lowering of treating activity, it is necessary that the quantity of methylnaphthalene in the heavy by-product oil to be treated is 2% by weight or less, preferably 1% by weight or less, and more preferably 0.5% by weight or less. In the treatment, it is also possible that the material to be treated is prepared by adding alkylbenzene such as toluene to the heavy by-product oil. However, too much addition lowers the treatment efficiency. Therefore, the addition quantity of toluene or the like is 20 times by weight of the by-product oil. Anyhow, it is necessary that the quantity of methylnaphthalene is 2% by weight or less in the material to be treated containing added toluene.

For obtaining the by-product oil containing less quantity of methylnaphthalene, any method of distillation, adsorption and extraction can be employed in addition to control alkylation conditions. In view of the fact that the material to be treated is a by-product oil, precise distillation is generally appropriate.

The catalyst used in the treatment of the present invention is a crystalline synthetic zeolite of 20 or higher in $SiO_2/Al_2O_3$ (molar ratio), the inlets of main pores of which are composed of ten-membered oxygen rings. In the following, the catalysts of this kind are described.

That is, the catalyst of crystalline synthetic aluminosilicate zeolite has a molar ratio as $SiO_2/Al_2O_3$ of 20 or higher and the inlets of main pores thereof are composed of ten-membered oxygen rings. Such zeolites are exemplified by ZSM-5 type synthetic zeolites having the inlets of main pores composed of ten-membered oxygen rings as well as zeolite zeta 1 and zeolite zeta 3. In other words, the zeolites used in the present invention are characterized in that the inlets of main pores are composed of ten-membered oxygen rings. Conventional synthetic zeolites such as zeolite A, erionite and offretite are small pore zeolites having eight-membered oxygen rings. Meanwhile, mordenite, zeolite X and zeolite Y are large pore zeolites having twelve-membered oxygen rings.

The effects of treatment with these conventional zeolites having eight-membered oxygen rings or twelve-membered oxygen rings are not high even when the quantity of methylnaphthalene is reduced because the structure of them are different from those used in the present invention.

Any of crystalline synthetic aluminosilicates as far as they are 20 or higher in molar ratio of $SiO_2/Al_2O_3$ and the inlets of main pores thereof are composed of ten-membered oxygen rings, can be used as the crystalline synthetic zeolite in the present invention. Especially preferable ones are ZSM-5 type synthetic zeolites known as ZSM-5, ZSM-11, ZSM-12, ZSM-22, ZSM-23, ZSM-35, ZSM-38 and ZSM-48. These ZSM-5 type synthetic zeolites have the structural characteristic that the inlets of main pores are composed of ten-membered oxygen rings. Furthermore, especially preferable synthetic zeolite is ZSM-5. The compositions and preparation methods for these ZSM-5 type zeolites are disclosed in the following patent gazettes.

ZSM-5: U.S. Pat. No. 3,702,886 British Patent No. 1,161,974 and Japanese Patent Pub. No. 46-10064

ZSM-8: British Patent No. 1,334,243

ZSM-11: U.S. Pat. No. 3,709,979 and Japanese Patent Pub. No. 53-23280

ZSM-21: U.S. Pat. No. 4,001,346

ZSM-35: Japanese Laid-Open Patent Publication No. 53-144500

Zeolite Zeta 1: Japanese Laid-Open Patent Publication No. 51-67299

Zeolite Zeta 3: Japanese Laid-Open Patent Publication No. 51-67298

The synthetic zeolite having the structural characteristic that the inlets of main pores are composed of ten-membered oxygen rings, has usually a high molar ratio of $SiO_2/Al_2O_3$ and the value is generally 20 or higher. In some case, the molar ratio of $SiO_2/Al_2O_3$ is very high, for example, the synthetic zeolite having the molar ratio as high as 1600 can be effective. Furthermore, it is possible to use in some case the zeolite having a value close to infinity in the molar ratio of $SiO_2/Al_2O_3$ which contains substantially no aluminum. Such "high-silica" zeolites are also included in the definition of the present invention. This molar ratio of $SiO_2/Al_2O_3$ can be determined by an ordinary analytical method such as atomic absorption spectrum analysis. This ratio is represented as close as possible to the ratio in the hard skeleton in zeolite crystal but the aluminum in cation form or other forms contained in a binder or channels are excluded.

The structure of ten-membered rings in the inlets of main pores is generally confirmed by X-ray diffractiometry. For example, synthetic zeolites of ZSM-5 type which are suitable as catalysts in the present invention show specific X-ray diffraction patterns, respectively.

It is, however, possible to use the values of constraint indexes in place of the X-ray diffractiometry. That is, the ten-membered oxygen ring in the present invention can be defined as the zeolite having constraint indexes of 1 to 12. By the way, the practical determination method of the constraint index is described in Japanese Laid-Open Patent Publication No. 56-133223. This index shows the degree that the micro pore structure of zeolite crystal restrains the access of molecules having cross sectional areas larger than that of n-paraffin. In the determination, as disclosed in the same reference, n-hexane and 3-methylpentane are adsorbed by zeolite under certain conditions and the indexes are calculated from adsorbed values.

Typical values of the constraint indexes are as follows:

| | Constraint Index |
|---|---|
| ZSM-5 | 8.3 |
| ZSM-11 | 8.7 |
| ZSM-35 | 4.5 |
| Amorphous Silica-Alumina | 0.6 |

The method for preparing zeolites used in the present invention will be described with reference to an example of the synthesis of ZSM-5. A mixture containing reactants of tetrapropylammonium hydroxide, sodium oxide, aluminum oxide, silicon oxide and water, is prepared in the first place. The composition may be made within the range as disclosed in the foregoing reference. The reaction mixture is then subjected to hydrothermal synthesis by heating. After the synthesis, the obtained crystal is baked in the air to obtain zeolite ZSM-5 catalyst. The tetrapropylammonium hydroxide can be synthesized in situ from n-propylamine and n-propylbromide in the reaction system. Aluminum oxide is used herein, however, it is also proposed to synthesize ZSM-5 containing substantially no aluminum atom. In the above method, tetrapropylammonium hydroxide is used, however, it is also proposed as the method for synthesizing ZSM-5 to use several other organic cations or organic compounds as their precursors in place of them.

Such compounds are exemplified by ammonia, trialkylmethylammonium cation, triethyl-n-propylammonium cation, $C_2$ to $C_9$ primary monoalkylamines, neopentylamine, di- and trialkylamines, alkanolamines, $C_5$ to $C_6$ alkyldiamines, $C_3$ to $C_{12}$ alkylenediamines, ethylenediamine, hexamethylenediamine, $C_3$ to $C_6$ diols, ethylene or propylene glycol, pentaerythritol, dipentaerythritol, 1,4-dimethoxycyclohexane, hydroquinone. ethylene oxide and ammonia, n-dodecylbenzene sulfonate, cyclopentadienyl phthalocyanine complex, 2-aminopyridine, ethylene glycol dimethyl ether, dioxane, dioxolan, tetrahydrofuran, and carboxylic acids such as tartaric acid. Furthermore, it is also proposed that, without adding organic cations or organic compounds as the precursor thereof as described above, ZSM-5 is added as the seeds in crystallization (e.g. Japanese Laid-Open Patent Publication No. 56-37215).

The zeolite used for the reaction contains metallic ions such as sodium ions which come from the reaction materials in synthesis. Besides the alkali metals such as sodium, it is possible to use those which are ion exchanged by other metals of alkaline earth metals such as calcium and magnesium and other trivalent metallic ions. Furthermore, crystalline synthetic aluminosilicate zeolite such as ZSM-5 type zeolite which is modified by impregnating it with magnesium, boron, potassium, phosphorus or their compounds, can also be used. These ion exchange and modification can be carried out according to conventionally known methods.

As described above, the crystalline synthetic zeolite used in the present invention can contain various kinds of metals. However, the hydrogen-type zeolite in which metallic ions are exchanged by hydrogen ions is included in the catalyst in the present invention. Typical hydrogen-type zeolite is prepared by a process such that the catalyst containing the organic cations in the catalyst preparation is heated, for instance, at about 400° to 700° C. for 1 hour in an inert atmosphere and it is then subjected to ion exchange with an ammonium salt or a mineral acid such as hydrochloric acid, and it is then baked, for example, at about 300° to 600° C. to be activated, thereby obtaining the what is called hydrogen-type zeolite.

The treatment according to the present invention is carried out at a temperature of 320° C. or lower. The treating temperature higher than this range is not desirable because the effect to limit the quantity of methylnaphthalene cannot be obtained. There is no lower limit of treating temperature, however, it is generally 200° C. or higher and preferably 220° C. or higher. The pressure may be a value at which the treatment can be carried out in a liquid phase. It is generally selected from the range of atmospheric pressure to 50 kg/cm$^2$.

The type of treatment is any of batchwise method and flow method. The latter flow method is preferable because the effect of the present invention is produced markedly. In the flow method, LHSV is in the range of 0.2 to 2.0, preferably 0.5 to 1.0.

When an obtained product treated by the process of the present invention is subjected to measurement of, for example, gas chromatography, the area of at least one of main peaks on a chromatogram is increased or decreased. As a result, it can be understood that a by-product oil was actually treated.

According to the present invention, when a by-product oil is treated with a specific catalyst, the lowering of treatment efficiency can be avoided by reducing the content of methylnaphthalene in a material to be treated to 2% by weight or less. As a result, it has been made possible to treat the by-product oil.

BEST MODE FOR CARRYING OUT THE INVENTION

In the following, the present invention will be described by examples.

PREPARATION EXAMPLE OF BY-PRODUCT OIL

Hydrogen-type synthetic zeolite (ZSM-5) was synthesized according to U.S. Pat. No. 3,702,886. 100 ml of this zeolite was fed into a stainless-made reaction tube and alkylation of toluene with ethylene was carried out. The reaction conditions were as follows:

Reaction Pressure: 20 kg/cm$^2$.G
Reaction Temperature: 340° C.
Ethylene/Toluene (molar ratio): 0.2
W H S V: 5

Unreacted toluene, ethyltoluene, diethyltoluene and most part of polyethyltoluene were distilled off from the reaction mixture to obtain bottom oil. This bottom oil was then subjected to reduced pressure distillation to obtain a fraction (1) of 240° to 275° C. in distilling temperature converted to atmospheric pressure.

This fraction (1) was further subjected to precise distillation under a reduced pressure to obtain a fraction (2) of 255° to 270° C. in distilling temperature converted to atmospheric pressure.

The conditions of the above reduced pressure distillation and the results of gas chromatographic analysis are shown in the following.

Fraction (1)
Number of Plates: 10
Reflux ratio: 3/1
Content of methylnaphthalene: 5.5% by weight
Fraction (2)
Number of Plates: 50
Reflux ratio: 20/1
Content of methylnaphthalene: 0.6% by weight

EXAMPLE

Treatment was carried out in the manner as follows with adding toluene to Fraction (2).

ZSM-5 catalyst which was prepared in the like manner as the above was filled into 250 ml vessel and the catalyst was dried for 3 hours by feeding dried air at 480° C. A mixture of 1 part by weight of toluene and 1 part by weight of Fraction (2) was passed through this vessel at a treating temperature of 260° C., a pressure of 20 atm (under nitrogen atmosphere) and an LHSV of 1.0.

By the way, it was noted that the X-ray diffraction pattern of ZSM-5 used herein was coincident with the one shown in the gazette of U.S. Pat. No. 3,702,886.

After the treatment for the predetermined time, the treated liquid was analyzed by gas chromatography. The results are shown in the following Table 1.

COMPARATIVE EXAMPLE

The foregoing Fraction (1) was treated together with toluene in the like manner as in the above Example, and after the treatment for the predetermined time, the treated liquid was analyzed by gas chromatography. The results are also shown in the following Table 1.

TABLE 1

| | Catalytic Efficiency (%) | | |
|---|---|---|---|
| Time of Feed (hr) | 300 | 1300 | 2800 |
| Example (Methylnaphthalene 0.3%) | 48 | 50 | 52 |
| Comparative Example (Methylnaphthalene 2.8%) | 45 | 8 | 0 |

METHOD FOR MEASURING CATALYTIC EFFICIENCY

In view of gas chromatographic patterns, the two kinds of fractions were almost similar to each other except the peaks of methylnaphthalene.

Thus, among the main peaks of both the fractions, corresponding peaks in which their area on the chromatograms were reduced, were checked up. The value of Catalytic Efficiency was determined by the ratio (%) (rate of areal reduction) between the area of a peak before the treatment and that of after the treatment.

It will be understood from the results in Table 1 that the lowering of catalytic efficiency was not observed in the treatment of the material containing 0.3% of methylnaphthalene. However, in the case of the material containing 2.8% of methylnaphthalene, the catalytic efficiency was lowered markedly.

INDUSTRIAL APPLICABILITY

As described above, it is possible to prevent the catalytic treatment from the lowering of its efficiency by treating the by-product oil with a specific catalyst with reducing the content of methylnaphthalene in the by-product oil which was obtained from the preparation process for alkylbenzene or the like.

We claim:

1. A process for treating a heavy by-product oil without lowering the efficiency of said treatment, wherein said by-product oil is produced for the alkylation of benzene or toluene with an alkylating agent in the presence of an alkylation catalyst, and wherein said oil contains 2% or less by weight methylnaphthalene, said process comprising heating said oil in a liquid phase in the presence of a crystalline synthetic zeolite catalyst having an $SiO_2/Al_2O_3$ molar ratio of 20 or higher.

2. The process of claim 1 wherein said catalyst is a zeolite having a $SiO_2/Al_2O_3$ molar ratio of up to 1600.

3. The process of claim 1 wherein said oil is heated at a temperature of about 200° C. to about 320° C. in the presence of said catalyst.

4. The process of claim 1 wherein said oil is heated to a temperature of up to 320° C.

5. The process of claim 3 wherein the oil is heated at a pressure of about atmospheric pressure to about 50 $Kg/cm^2$.

6. The process of claim 1 wherein the oil comprises main oil components having a boiling point range from 255° C. to 270° C.

7. The process of claim 1 wherein said oil comprises main oil components having a boiling point in the range of about 240° C. to 350° C.

8. The process of claim 1 wherein said oil contains less than 1% by weight methylnaphthalene.

9. The process of claim 1 wherein the oil contains less than 0.5% by weight methylnaphthalene.

10. The process of claim 1 further including the step of adding an alkyl benzene to said oil in an amount to reduce the methylnaphthalene content to less than 2% by weight when the oil from said alkylation contains greater than 2% by weight methylnaphthalene.

11. The process of claim 1 further comprising the step of reducing the methylnaphthalene content of said oil to less than 2.0% by weight when said oil from said alkylation contains greater than 2.0% by weight methylnaphthalene.

12. The process of claim 1 wherein said catalyst is a synthetic zeolite having ten-membered oxygen rings.

13. The process of claim 12 wherein said synthetic zeolite is selected from the group consisting of ZSM-5 type zeolite catalysts.

14. The process of claim 13 wherein said ZSM-5 type zeolite is ZSM-5.

15. The process of claim 1 wherein said zeolite catalyst is selected from the group consisting of ZSM-5, ZSM-11, ZSM-22, ZSM-23, ZSM-35, ZSM-38, ZSM-48, zeolite zeta-1, and zeolite zeta-3.

16. The process of claim 1 wherein said alkylation is ethylation using ethylene as the alkylating agent.

17. A process for treating a heavy by-product oil produced from the alkylation of benzene or toluene with an alkylating agent in the presence of an alkylation catalyst, said process comprising reducing the methylnaphthalene content of the heavy by-product oil to 2% or less by weight and then heating the oil in a liquid phase in the presence of a crystalline synthetic zeolite catalyst having an $SiO_2/Al_2O_3$ molar ratio of 20 or higher.

18. A process as claimed in claim 17 wherein the methylnaphthalene content of the heavy by-product oil is reduced by distillation.

19. A process as claimed in claim 17 wherein said synthetic zeolite is selected from the group consisting of ZSM-5 type zeolite catalyst.

20. A process as claimed in claim 19 wherein said ZSM-5 type zeolite is ZSM-5 and said alkylation is ethylation using ethylene as the alkylating agent.

* * * * *